United States Patent [19]

Ban et al.

[11] Patent Number: 4,981,218

[45] Date of Patent: Jan. 1, 1991

[54] DEVELOPER CARTRIDGE

[75] Inventors: Yutaka Ban, Tokyo; Mayumi Kashiwagi, Fujishiromachi, both of Japan

[73] Assignee: Canon Kabushiki Kaisha, Tokyo, Japan

[21] Appl. No.: 469,392

[22] Filed: Jan. 24, 1990

[30] Foreign Application Priority Data

Jan. 27, 1989 [JP] Japan ..... 1-016367

[51] Int. Cl.[5] ..... B65D 43/02

[52] U.S. Cl. ..... 206/633; 222/DIG. 1; 229/123.1; 355/260

[58] Field of Search ..... 229/123.1; 206/633; 222/DIG. 1; 355/260

[56] References Cited

U.S. PATENT DOCUMENTS

| | | | |
|---|---|---|---|
| 3,076,588 | 2/1963 | Conway et al. | 229/123.1 |
| 3,454,210 | 7/1969 | Spiegel et al. | 206/633 |
| 3,717,533 | 2/1973 | Mayworm et al. | 206/633 |
| 3,854,653 | 12/1974 | Engelsberger | 206/633 |
| 3,999,654 | 12/1976 | Pollack | 206/633 |
| 4,478,512 | 10/1984 | Zoltner | 206/633 |
| 4,573,614 | 3/1986 | Ozawa | 222/DIG. 1 |
| 4,614,286 | 9/1986 | Yamaguchi | 222/DIG. 1 |
| 4,827,307 | 5/1989 | Zoltner | 206/633 |
| 4,931,838 | 6/1990 | Ban et al. | 222/DIG. 1 |

*Primary Examiner*—Stephen P. Garbe

*Attorney, Agent, or Firm*—Fitzpatrick, Cella, Harper & Scinto

[57] ABSTRACT

A developer cartridge for supplying developer to a latent image developing device, comprising a container accommodating the developer therein and having a developer discharge opening, and a sealing member detachably adhered to the container to seal the opening, wherein an adhesion portion between the container and the sealing member includes an enclosure area surrounding the opening, a peeling force absorbing area, and a peeling force reducing area.

7 Claims, 4 Drawing Sheets

DEVELOPER CARTRIDGE

BACKGROUND OF THE INVENTION

Field of the Invention and Related Art

The present invention relates to a developer cartridge for supplying developer to an image forming apparatus adopting to a process for forming an electrostatic latent image and developing the same, such as an electrophotographic copying machine, electrophotographic laser beam printer and the like.

In an image forming apparatus adopting to an electrophotographic process, it is necessary to visualize an electrostatic latent image formed on an image bearing member by developer (toner) in a developing device. The toner should be replenished to the image forming apparatus at need, and such replenishment of the toner is sometimes effected by the use of a developer cartridge wherein an opening is sealed by a sealing member. The developer cartridge can supply the developer contained therein to the image forming apparatus through the opening, by freeing or opening the opening by peeling the sealing member from the opening after the developer cartridge has been mounted on a predetermined position in the image forming apparatus.

Explaining an example of the developer cartridge of this kind with reference to FIG. 1, a developer cartridge 100 comprises a box-like container 110 having a longitudinal opening 111 and containing developer therein, and a sealing member 120 adhered to an adhesion portion 112 formed around the opening 111 of the container 110 to seal the container 110. The sealing member 120 is folded back along a folding line 121, and a gripping portion 122 of the folded portion is positioned to the end portion (right side in FIG. 1) of the container 110. When an operator pulls the gripping portion 122 of the sealing member 120 in a direction P shown by &he arrow to peel the sealing member 120 from the adhesion portion 112 of the container 110, the opening 111 is exposed, whereby the toner in the developer cartridge 100 can be easily taken out.

The peeling force for the sealing member 120 is closely related to the configuration of the adhesion portion 112, and the longer the dimension of the adhesion portion 112 perpendicular to the peeling direction (direction P), the stronger the peeling force. In many cases, as shown in FIG. 1, since the configuration of the opening 111 of the developer cartridge 100 is generally rectangular, the configuration of the adhesion portion 112 is also generally rectangular along the opening 111. Accordingly, in the case of the prior art shown in FIG. 1, when the sealing member 120 is peeled from the container 110, generally, the large force will be required at the start and the end of the peeling operation.

However, at the end of the peeling operation for the sealing member 120, since the resistance is extinguished suddenly, the cartridge moves or vibrates suddenly due to the reaction with the result that the toner in the cartridge flows out to smear the surroundings, or the sealing member 120 is suddenly pulled toward the operator's hand with the result that the sealing member 120 peeled off and attaching the toner is contacted or adhered to the operator's hand or wear, thus smearing them.

In order to eliminate such disadvantage, a technique that the sealing member is wound around a take-up member has been proposed as disclosed in the Japanese Patent Laid-open No. 60-41068. However, in this case, the arrangement is complicated, the number of parts is increased to worsen the productivity, and the manufacturing cost is also increased.

Further, a method in which the sealing member is not completely peeled off from the container and adhered partly to the latter can be adopted or used. However, in this case, it is difficult to use the developer cartridge in the case where the developer is replenished into a developing device of a process cartridge having a photosensitive member, chargers and the dveloping device and insertable into an image forming apparatus as disclosed in the Japanese Patent Laid-open No. 59-13262 or in the case where the developer cartridge is maintained within an image forming apparatus after it has been opened and rotated as disclosed in the Japanese Patent Laid-open No. 60-87371.

SUMMARY OF THE INVENTION

An object of the present invention is to provide a developer cartridge which can eliminate the above-mentioned drawbacks.

Another object of the present invention is to provide a developer cartridge wherein, after a sealing member has been peeled from an opening of a container, the sealing member can be separated from the container slowly without excessiveness.

Other objects and features will be apparent from the following description in connection with the accompanying drawings.

DESCRIPTION OF THE PREFERRED EMBODIMENT

Figure 1:
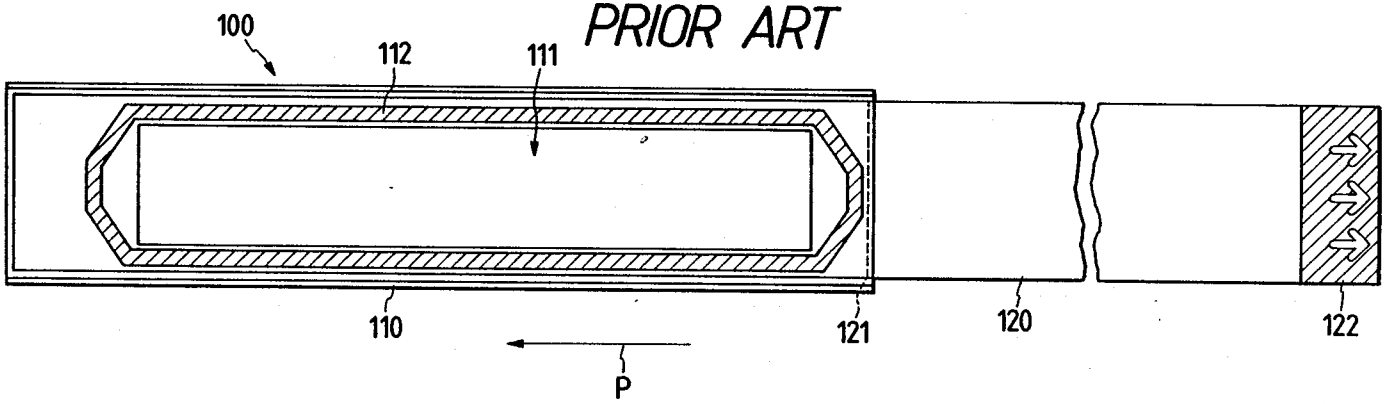
FIG. 1 PRIOR ART
FIG. 1 is a plan view of a conventional developer cartridge.
Figure 2:
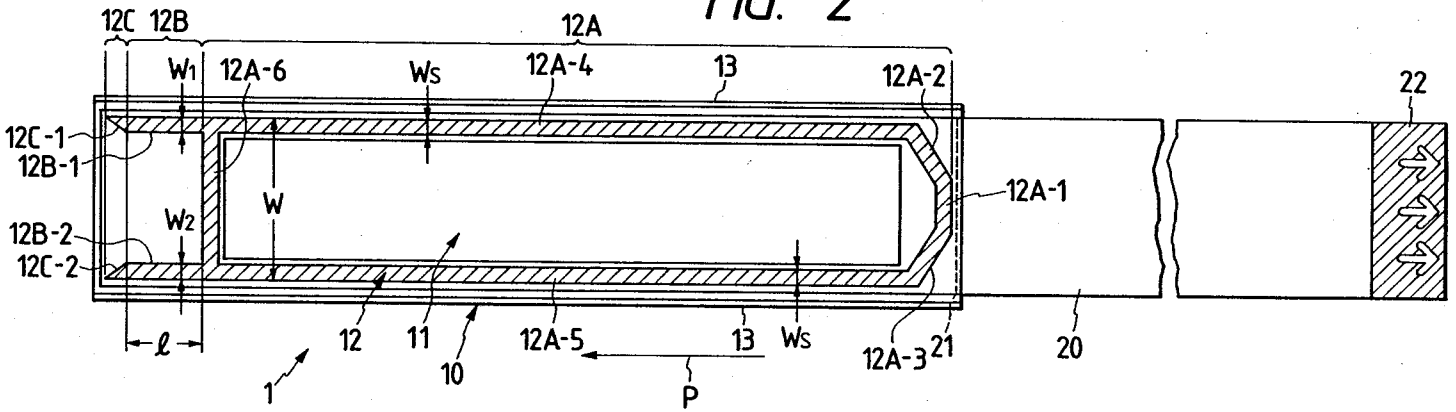
FIG. 2 is a plan view of a developer cartridge according to a preferred embodiment of the present invention.

FIG. 2 is a bottom plan view of a developer cartridge 1 for replenishing developer (toner) to an electrophotographic image forming apparatus. The developer cartridge 1 comprises a box-like container 10 accommodating the toner powder therein, and a flexible sealing member 20 for sealing an opening 11 of the container through which the toner flows out of the container. The container 10 may be made of synthetic resin, paper or the like, and the opening 11 of the container is substantially rectangular along the longitudinal direction of the container 10. An adhesion portion (hatched portion) 12 is provided around the opening 11, and the sealing member 20 is adhered to the container 10 at the adhesion portion 12.

Guides 13 are protruded from the lower surface of the container 10 at both sides of the sealing member 20, so that when the sealing member 20 is pulled in a direction shown by the arrow P to peel it from the container 10, the sealing member is prevented from deviating from a predetermined path.

The sealing member 20 is made of a flexible sheet material such as synthetic resin, paper, metal foil or the like and is adhered to the adhesion portion 12 of the container 10 by means of heat seal, hot melt, impulse seal, high frequency welder and the like so that the sealing member can be easily peeled from the adhesion portion 12 of the container 10. Incidentally, the adhesion force of the sealing member 20 to the container 10 is so selected that the sealing member 20 is not unsealed due to the vibration, dropping shock during the transportation thereof, or due to the variation in the circumferential conditions (particularly, reduction in pressure).

Figure 3:
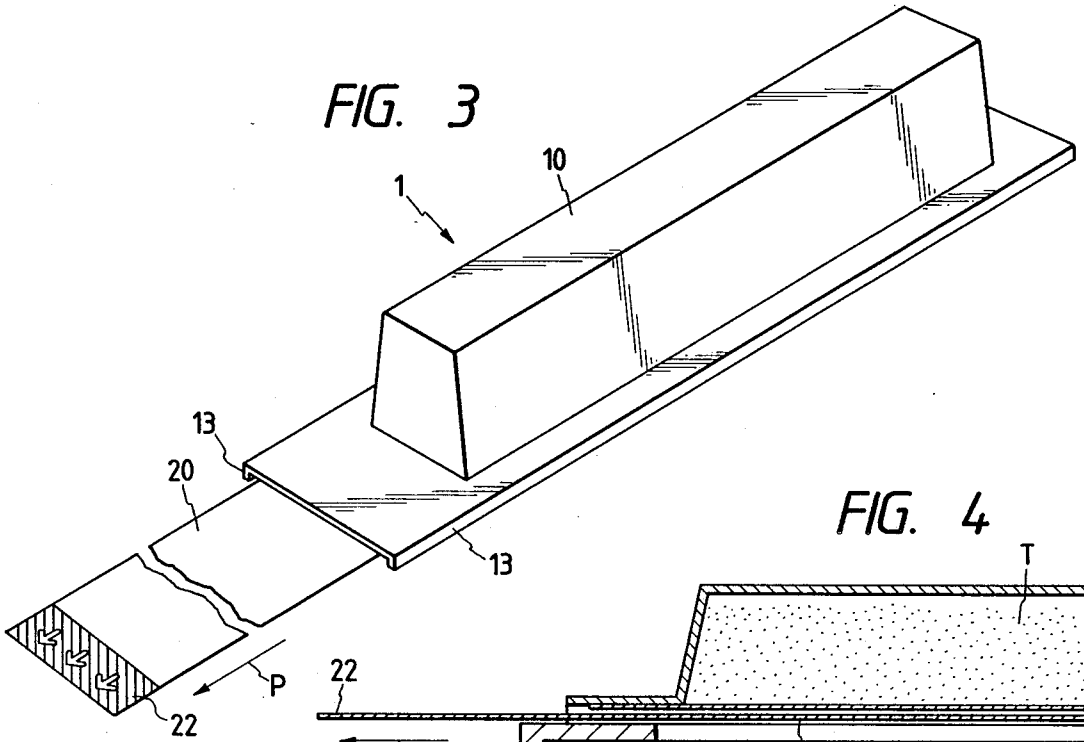
FIG. 3 is a perspective view of the developer cartridge of FIG. 2.
Figure 4:
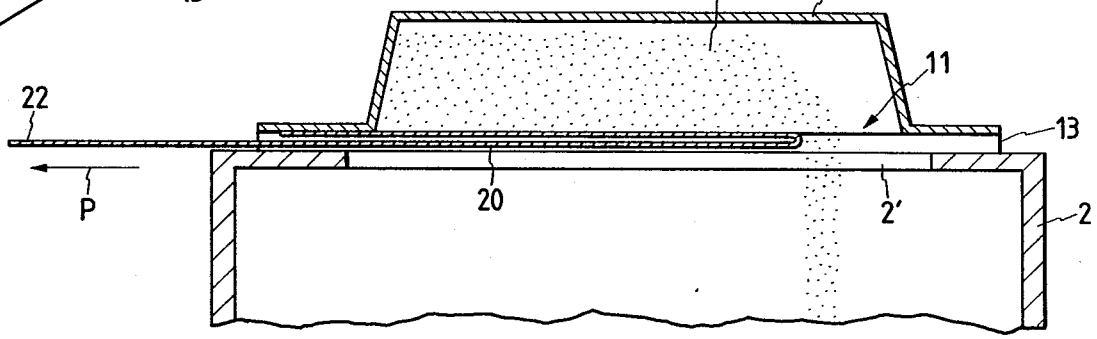
FIG. 4 is a sectional view of the developer cartridge of FIG. 2.

In FIG. 2, while the sealing member 20 is shown in the developed condition at the right side of the container 10, actually, the sealing member 20 is fold back along a folding line 21 positioned at the right portion of the adhesion portion 12 to protrude from the left side of the container 10 as shown in FIG. 3. A grip 22 is formed on the free end of the protruded sealing member 20 to facilitate the peeling of the sealing member from the container 10. In the illustrated embodiment, while the grip 22 is provided by printing the arrows presenting the peeling direction on the free end of the sheet-shaped sealing member, the grip may be constituted by a hard member attached to the free end of the sealing member. In any case, when the operator grips the grip 22 of the sealing member 20 and pulls it to the direction P (substantially parallel to the longitudinal direction of the container 10), as shown in FIG. 4, the sealing member 20 is gradually peeled from the container while maintaining the folded condition.

In this way, the opening 11 is exposed, and the toner T in the container 10 drops into a toner reservoir 2 of the developing device through the opening 11. Incidentally, it is preferable that the peeling operation of the sealing member 20 is performed after the container 10 has been arranged on the toner reservoir 2 so that an opening 2' of the reservoir 2 is aligned with the toner discharge opening 11 of the container 10.

The adhesion portion 12 of the container 10 is arranged around the opening 11 with a constant width Ws and comprises an enclosure area 12A for surrounding the opening 11, a peeling force absorbing area 12B for supporting and absorbing the inertia force upon completion of the peeling to prevent the sudden approach of the sealing member toward operator or the sudden movement or vibration of the container due to the reaction when the sealing member 20 is peeled off from the enclosure area 12A, and a peeling force reducing area 12C for gradually reducing the peeling force when the sealing member 20 is completely separated from the container 10.

The enclosure area 12A includes portions 12A-1, 12A-2, 12A-3, 12A-4, 12A-5 and 12A-6.

In the intermediate zone of the enclosure area 12A, the sealing member may be peeled only along the adhesion width (2Ws) of the longitudinal portions 12A-4 and 12A-5. However, at the start and the end of the peeling operation, since the adhesion width perpendicular to the peeling direction is wider, the stronger peeling force is required. In order to facilitate the start of the peeling of the sealing member 20, the adhesion width (perpendicular to the peeling direction P) of the front portion 12A-1 (corresponding to the peeling start position) of the enclosure area 12A is made narrower than the distance between the longitudinal portions 12A-4 and 12A-5, and, preferably, than the width of the opening 11. The front portion 12A-1 is connected to the longitudinal portions 12A-4 and 12A-5 arranged along the longitudinal direction of the opening 11 (i.e., the peeling direction P) through inclined portions 12A-2 and 12A-3, respectively.

On the other hand, since a rear portion 12A-6 (corresponding to the peeling end position) of the enclosure area 12A is connected to the longitudinal portions 12A-4 and 12A-5 in the direction perpendicular to the peeling direction P, the larger peeling force is also required at the rear portion 12A-6. When this larger peeling force is suddenly extinguished at the peeling completion point, there arises the problem as mentioned above. In the example shown in FIG. 2, the rear portion 12A-6 is arranged to elongate in the direction perpendicular to the peeling direction P, and accordingly, the adhesion width W thereof equals the distance between the outer edges of the intermediate longitudinal portions 12A-4 and 12A-5. That is to say, the adhesion width W substantially equals the sum of the widths of the longitudinal portions (2Ws) and the width of the opening 11, and the peeling force becomes maximum at the rear portion 12A-6.

The peeling force absorbing area 12B includes first and second portions 12B-1 and 12B-2. Each portion 12B-1, 12B-2 is constituted by extensions of the longitudinal portions 12A-4, 12A-5 and extends along the peeling direction P by a distance (. In order to support or receive the peeling inertia force at the rear portion 12A-6, the first and second absorbing portions 12B-1 and 12B-2 are connected to the rear portion 12A-6 of the enclosure area 12A.

Incidentally, the first and second absorbing portions 12B-1 and 12B-2 have widths W1 and W2, respectively. The widths W1 and W2 may be different from each other, but, preferably, these widths are the same.

The total adhesion width $\Sigma Wn(=W1+W2)$ of the absorbing area 12B is preferably smaller than the maximum adhesion width W of the enclosure area 12A, i.e., the width of the rear portion 12A-6; however, if too smaller, the peeling force absorbing effect is reduced, with the result that the length l of the absorbing area must be longer. To the contrary, if the total adhesion width $\Sigma Wn$ is too larger, the peeling force reducing area 12C must be longer to smoothly separate the sealing member 20 from the adhesion portion 12. Therefore, the relation between the length l (mm) of the absorbing area 12B, the total adhesion width $\Sigma Wn$ (mm) thereof and the adhesion width W (mm) of the rear portion 12A-6 of the enclosure area 12A may be selected in accordance with the following condition:

$$l \leqq (W/\Sigma Wn) \cdot F \cdot W \quad (1)$$

Here, F is an adhesion force between the sealing member 20 and the container 10 in a unit area, i.e., a force ($kg/mm^2$) required for peeling the sealing member. Of course, the condition (1) is mere sim or standard, and, accordingly, the value 193 Wn which do not meet the condition (1) can be utilized.

Next, the peeling force reducing are 12C includes first and second portions 12C-1 and 12C-2 contiguous to the rear ends of the first and second absorbing portions 12B-1 and 12B-2, respectively. The adhesion width of each of the first and second portions 12C-1, 12C-2 is gradually reduced in the peeling direction P of the sealing member to gradually decreases the pulling force required for separating the sealing member 20 from the container 10. In FIG. 2, while the first and second portions 12C-1, 12C-2 are shown to each have a triangle shape, any configuration of the first and second portions 12C-1, 12C-2 such as trapezoidal shape and semi-oval shape may be utilized so long as the width thereof is gradually reduced in the peeling direction P.

Incidentlly, in this disclosure, the term "width" means a dimension in the direction perpendicular to the peeling direction P, and "length" means a dimension in the peeling direction P.

The developer cartridge 1 is mounted within a developer supplying portion of the image forming apparatus such as a copying machine in the condition that the opening 11 is directed downwardly as shown in FIGS. 3 and 4. Then, the sealing member 20 is pulled or peeled along the guides 13 to open or expose the opening 11, with the result that the toner is supplied to the toner reservoir 2 through the opening. When the sealing member 20 is completely separated from the container 10, the container will be substantially empty. Thereafter, the operator knocks the container 10 from the outside thereof by a few times to drop the remaining toner attached to the inner surface of the container into the reservoir completely. Then, the empty container is removed from the image forming apparatus.

Now, the force required for peeling the sealing member 20 from the adhesion portion 12 of the container 10 will be explained by using the concrete numbers in connection with the developer cartride 1 having a standard size shown in FIG. 2. At the peeling start portion or front portion 12A-1 of the enclosure area 12A surrounding the opening 11, the peeling force is in the order of 2–4 kg. The peeling force is immediately decreased so that it has a stable value of about 1 kg at the intermediate longitudinal portions 12A-4, 12A-5.

Then, when the peeled sealing member 20 reaches the rear portion 12A-6 of the enclosure area 12A, the peeling force suddenly increase to a value of the order of 4–6 kg. When the sealing member 20 is completely peeled off from the enclosure area 12A to expose the opening 11 of the cartridge 1, the sealing member 20 is peeled from the absorbing area 12B contiguous to the enclosure area 12A. Since the peeling force in the absorbing area 12B is smaller, the sealing member 20 is peeled from the absorbing area 12B in some extent by the remaining power of the peeling from the enclosure area 12A. However, the inertia force (the remaining force) is absorbed by the absorbing area immediately, and thereafter, the sealing member 20 is peeled slowly from the absorbing area 12B at the peeling force of the order of 1 kg.

When the sealing member reaches the peeling force reducing area 12C, the peeling force is gradually decreased along this area, and at last, the peeling force is reduced to zero when the sealing member leaves this area 12C, whereby the sealing member 20 can be separated from the container 10 smoothly without excessiveness.

As mentioned above, in the illustrated embodiment, since the adhesion portion 12 of the container 10 for the sealing member 20 is provided with the peeling force absorbing area 12B and the peeling force reducing area 12C, as well as the enclosure area 12A, the sealing member 20 can be smoothly peeled from the container 10 without excessiveness, thus preventing the smear of the operator's hand and/or wear due to the scattering of the toner and/or the attaching of the sealing member 20 which arose the problem in the prior art.

Incidentally, in the illustrated embodiment, while the absorbing area 12B had the shape as shown in FIG. 2, the configuration of such absorbing area is not limited to such shape. For example, the absorbing area may be inclined with respect to the peeling direction P or may be curved. Further, in the example shown in FIG. 2, while the absorbing area 12B was constituted by the two parallel adhesion portions 12B-1 and 12B-2 extending in the peeling direction P, the absorbing area may be constituted by three or more parallel adhesion portions extending in the peeling direction P, or may be constituted by a single adhesion portion.

Further, of course, the shape of the container 10 may be circular.

Next, an example of a developing device wherein the developer can be supplied by the developer cartridge according to the present invention will be explained.

Figure 5:
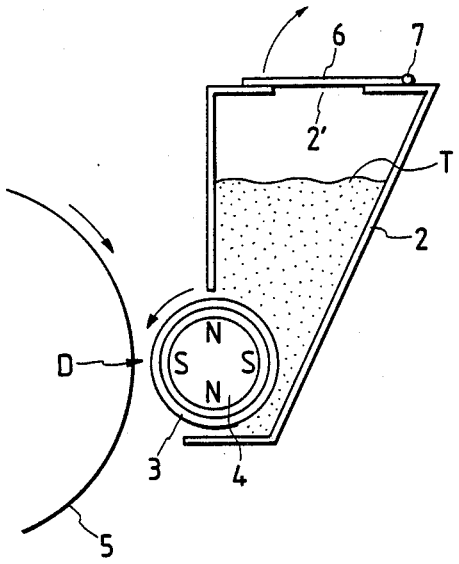
FIG. 5 is a sectional view of a developing device to which the present invention is applicable.

In FIG. 5, a non-magnetic sleeve 3 is arranged in the toner reservoir 2 at the lower portion thereof, which sleeve includes a fixed magnet 4 therein. The sleeve 3 bears thereon one-component magnetic developer (magnetic toner) T supplied from the toner reservoir 2, and conveys the toner to a developing station D2 by the rotation thereof.

In the developing station D2, the toner is applied onto an electrophotographic photosensitive member 5, thereby visualizing an electrostatic latent image formed on the photosensitive member 5. Around the photosensitive member 5, conventional process devices such as a charger, image exposing device, transfer device, cleaning device and the like are arranged.

When the toner in the toner reservoir is reduced or used up, a door 6 pivotably mounted on the upper portion of the toner reservoir by means of a hinge 7 is opened to expose an opening 2', and then the developer cartridge 1 is disposed on the reservoir 2 as shown in FIG. 4 to replenish the toner.

While FIG. 5 shows the developing device using the one-component magnetic developer, the present invention can be also applied to any developer supplying cartridge used to the developing device utilizing one-component non-magnetic developer or the developing device utilizing two-component developer. Incidentally, in the developing device utilizing the two-component developer, it is preferable that, as well as the toner reservoir, there is provided a developing chamber within which a sleeve is arranged and the two-component developer is accommodated, whereby the toner is intermittently supplied from the toner reservoir to the developing chamber.

Figure 6:
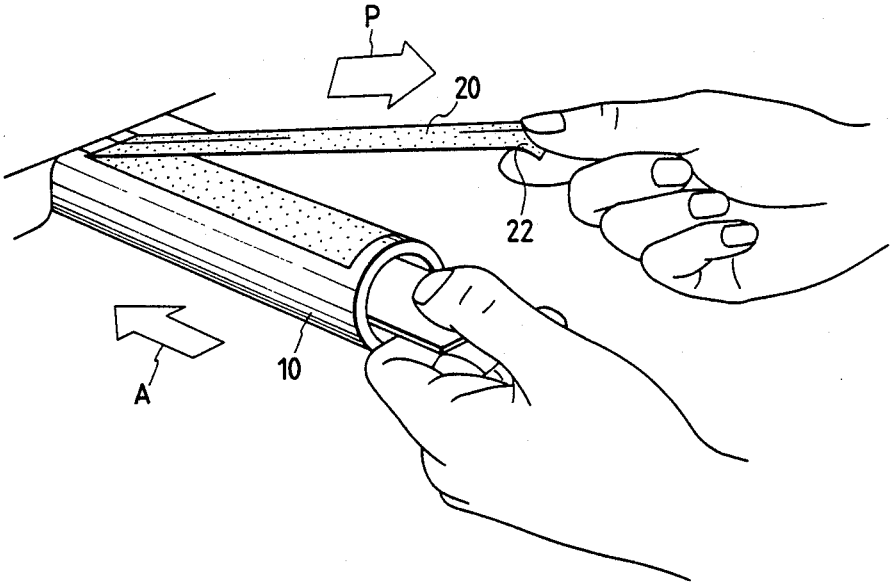
FIGS. 6 and 7 are explanatory views for explaining another embodiment of the present invention.
Figure 7:
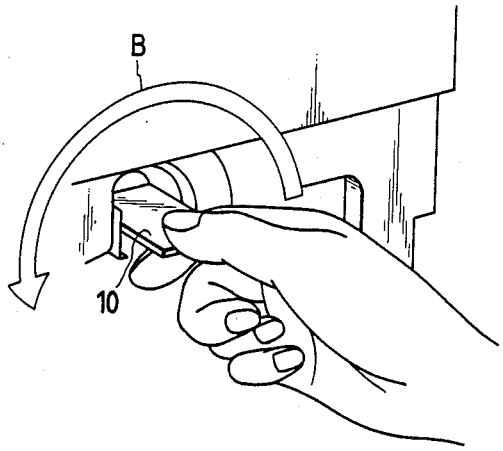
Figure 8:
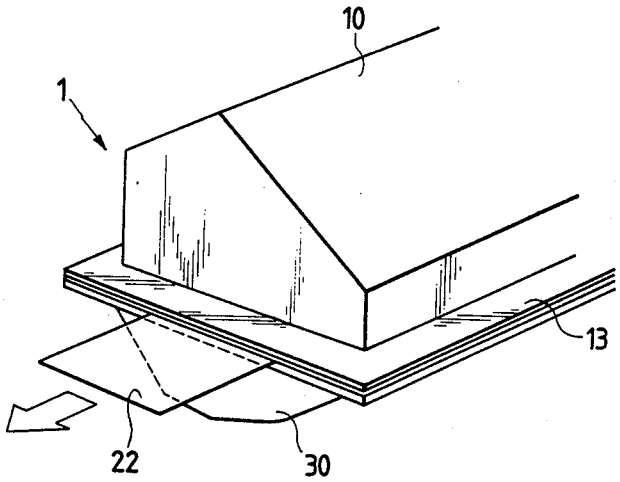
FIG. 8 is a perspective view of a developing cartridge according to a further embodiment of the present invention.

In the illustrated embodiment, while the developer cartridge which can immediately supply the toner upon unsealed and removed from the developing device was explained, the present invention is not limited to such developer cartridge. For example, as shown in FIGS. 6 and 7, the present invention can be applied to a developer cartridge wherein the container 10 is inserted into the developing device in a direction shown by the arrow A while peeling the sealing member 20 in the peeling direction P, and after the sealing member 20 has been separated from the container 10 the container is rotated in a direction shown by the arrow B to direct the opening downwardly and the container is held in the developing device to gradually supply the toner, or can be applied to a developer container 10 (FIG. 8) which is integrally attached to a process cartridge 30 including an image bearing member and the developing device therein and which is removably mounted within the image forming apparatus together with the process cartridge (as disclosed in the Japanese Patent Laid-open No. 59-13262). Particularly, in these cases, since the sealing member 20 must be completely separated from the container 10, the advantage obtained by the present invention is particularly excellent.

What is claimed is:

1. A developer cartridge comprising:

a container for accommodating developer developing an electrostatic latent image, said container including an opening through which the developer flows out of said container;

a sealing member for sealing said opening, said sealing member being adhered to said container in such a manner that said sealing member can be peeled from said container by pulling said sealing member in one direction; and wherein an adhesion portion between said container and said sealing member includes an enclosure area surrounding said opening, a peeling force absorbing area contiguous to a rear portion of said enclosure area, and a peeling force reducing area contiguous to a rear portion of said peeling force absorbing area.

2. A developer cartridge according to claim 1, wherein a width of said peeling force absorbing area is narrower than that of the rear portion of said enclosure area, and a width of said peeling force reducing area is gradually reduced with respect to said one direction to which said sealing member is pulled.

3. A developer cartridge according to claim 2, wherein a width of a front portion of said enclosure area is narrower than a distance between both edges in an intermediate portion thereof.

4. A developer cartridge according to any one of claims 1 to 3, wherein said sealing member is folded back toward a rear side of said adhesion portion at a front side of the adhesion portion, a grip is provided on a free end of the folded portion of said sealing member, and said sealing member is pulled and peeled from said container while being maintained in the folded condition.

5. A developer cartridge comprising:

a container for accommodating developer developing an electrostatic latent image, said container including a rectangular opening through which the developer flows out of said container;

a sealing member for sealing said opening, said sealing member being detachably adhered to said container and being folded back toward a rear side of an adhesion portion at a front side of the adhesion portion and being provided with a grip on a free end of the folded portion of said sealing member, and said sealing member being peeled from said container by pulling said sealing member in a longtiudinal direction of said opening while being maintained in the folded condition; and wherein said adhesion portion between said container and said sealing member includes an enclosure area surrounding said opening, first and second peeling force absorbing portions contiguous to a rear portion of said enclosure area, and first and second peeling force reducing portions contiguous to rear portions of said first and second peeling force absorbing portions; and further, wherein a total width of said first and second peeling force absorbing portions is narrower than that of the rear portion of said enclosure area, and a width of each of said first and second peeling force reducing portions is gradually reduced with respect to the direction to which said sealing member is pulled.

6. A developer cartridge according to claim 5, wherein a width of a front portion of said enclosure area is narrower than a distance between both edges in an intermediate portion thereof.

7. A developer cartridge according to claim 5 or 6, wherein said first and second peeling force absorbing portions are arranged on extension lines of first and second longitudinal portions of said enclosure area extending in the longitudinal direction of said opening.

* * * * *

UNITED STATES PATENT AND TRADEMARK OFFICE

CERTIFICATE OF CORRECTION

PATENT NO. : 4,981,218

DATED : January 1, 1991

INVENTOR(S) : YUTAKA BAN, ET AL.

It is certified that error appears in the above-identified patent and that said Letters Patent is hereby corrected as shown below:

COLUMN 1

Line 8, "adopting to" should read --utilizing--.
Line 12, "adopting to" should read --utilizing--.
Line 38, "&he" should read --the.
Line 46, "stronger" should read --larger--.
Line 53, "the" should read --a-- and
Line 63, "wear," should read --clothing,--.

COLUMN 2

Line 10, "dveloping device" should read --developing device--.
Line 11, "and" should read --are--.

COLUMN 3

Line 12, "the" (first occurrence) should be deleted.
Line 17, "fold" should read --folded--.
Line 24, "presenting" should read --representing--.
Line 29, "to" should read --in--.
Line 48, "operator" should read --the operator--.
Line 62, "the stronger" should read --a larger--.

UNITED STATES PATENT AND TRADEMARK OFFICE

CERTIFICATE OF CORRECTION

PATENT NO. : 4,981,218

DATED : January 1, 1991

INVENTOR(S) : YUTAKA BAN, ET AL.

It is certified that error appears in the above-identified patent and that said Letters Patent is hereby corrected as shown below:

COLUMN 4

Line 11, "the" should read --a--.
Line 29, "distance (." should read --distance ℓ.--.
Line 42, "smaller" should read --small--.
Line 44, "To" should read --On--.
Line 45, "larger" should read --large--.
Line 54, "$\ell \leqq (W/\Sigma Wn) \cdot F \cdot W$" should read --$\ell \geqq (W/\Sigma Wn) \cdot F \cdot W$--.
Line 60, "value 193 Wn" should read --values ℓ, ΣWn--.
Line 62, "reducing are 12C" should read --reducing area 12C--.
Line 68, "decreases" should read --decrease--.

COLUMN 5

Line 8, "Incidentlly," should read --Incidentally,--.
Line 23, "by" should be deleted.
Line 30, "developer cartride 1" should read --developer cartridge 1--.
Line 39, "increase" should read --increases--.
Line 47, "power" should read --force--.
Line 68, "wear" should read --clothing--.

COLUMN 6

Line 2, "which arose the problem" should read --which problem arose--.
Line 25, "developing station D2" should read --developing station D--.
Line 27, "developing station D2," should read --developing station D,--.
Line 40, "the" (second occurrence), should read --a--.
Line 46, "the" (second occurrence), should read --a--.
Line 55, "unsealed" should read --being unsealed--.

UNITED STATES PATENT AND TRADEMARK OFFICE

CERTIFICATE OF CORRECTION

PATENT NO. : 4,981,218

DATED : January 1, 1991

INVENTOR(S) : YUTAKA BAN, ET AL.

It is certified that error appears in the above-identified patent and that said Letters Patent is hereby corrected as shown below:

COLUMN 7

Line 11, "developer developing" should read --developer for developing--.

COLUMN 8

Line 4, "developer developing" should read --developer for developing--.
Line 16, "tiudinal" should read --ditudinal--.

Signed and Sealed this

Eighteenth Day of August, 1992

*Attest:*

*Attesting Officer*

DOUGLAS B. COMER

*Acting Commissioner of Patents and Trademarks*